United States Patent [19]

Ellington et al.

[11] 4,055,922

[45] Nov. 1, 1977

[54] FRAME STRUCTURE FOR SWIMMING POOL

[75] Inventors: Harold John Ellington, Basking Ridge; Roy C. McNeil, Paterson, both of N.J.

[73] Assignee: Heldor Associates, Inc., Clifton, N.J.

[21] Appl. No.: 726,127

[22] Filed: Sept. 24, 1976

[51] Int. Cl.[2] ..... E04H 3/18; E04B 1/32

[52] U.S. Cl. ..... 52/169.7; 4/172.19; 52/245

[58] Field of Search ..... 52/245, 249, 169.7, 52/169.8; 4/172, 172.19

[56] References Cited

U.S. PATENT DOCUMENTS

| | | | |
|---|---|---|---|
| 3,317,927 | 5/1967 | Shields | 52/247 X |
| 3,593,348 | 7/1971 | Toerge | 4/172.19 |
| 3,938,199 | 2/1976 | Laven | 4/172.19 |

FOREIGN PATENT DOCUMENTS

| | | | |
|---|---|---|---|
| 1,185,391 | 3/1970 | United Kingdom | 52/245 |

*Primary Examiner*—J. Karl Bell

*Attorney, Agent, or Firm*—Carella, Bain, Gilfillan & Rhodes

[57] ABSTRACT

The structure of forming panels and panel segments for use in assembling free form pools is disclosed. Structural relationships regarding radius of bend of the forming panels and their lengths in terms of angle of arc defined per panel permit the construction of a plurality of pool shapes, e.g. kidney, oval, figure-eight, from a minimum of panel and panel segments.

19 Claims, 10 Drawing Figures

FRAME STRUCTURE FOR SWIMMING POOL

BACKGROUND OF THE INVENTION

The present invention relates generally to the field of swimming pools. More particularly, the present invention relates to swimming pools of the type wherein a pool shape is defined by a plurality of panels and the water containing portion is thereafter inserted within the assembled pattern paneled sections, the water containing portion being in the nature of a pool liner.

It is well recognized in the art to utilize metal to form panel sections to outline the desired shape of a swimming pool whereafter a liner is inserted for containing the swimming pool water. There are pools which are rectangular in shape and square in shape as well as "free form" pools such as kidney, oval and figure-eight shaped pools.

The present invention directs itself to difficulties which have arisen with respect to the manufacture and assembly of panels and panel segments for constructing the "free form" pools. As will be recognized by those skilled in these arts the use of metal panels in constructing "free form" pools has been approached in two ways. On the one hand, pool manufacturers have utilized a plurality of straight panel sections in conjunction with a plurality of pre-curved sections to construct pools of various shapes. Although these pools are sometimes designated "free form" pools, the existence of the straight sections precludes them from being properly categorized as "free form." Other manufacturers have recognized that "free form" pools embody no straight sections and have attempted to overcome these problems by forming the paneled sections to desired shape on the pool site.

Referring to FIGS. 1 and 2 which show a typical prior art panel, it can be seen that the basic section of the panel includes an upper shoulder and a lower shoulder which are provided with a plurality of V shaped notches. The V shaped notches are provided to define bending lines around which the wall section of the panel may bend as the assembler bends the panels to a desired shape on the pool site. Thus, support elements such as stakes are driven into the ground in position to define the desired shape of the pool and the panels are bent therearound. Once the panels are bent to desired shape they are secured together in a conventional manner, e.g. by bolting or the like and the supporting stakes are removed.

The problems attendant to the construction of pools in this manner is that in pools of this type the panels are anchored at their bottom by concrete collars which are poured subsequent to the positioning of the panels. Also, there is provided around the pool tops concrete collars defining supports and anchors for the pool deck structure. Because of the construction of the conventional panels, e.g. a single lip having notches formed therein, there is no specific structural bond between the concrete and the pool panels. Thus it has been known that subsequent to the pouring and hardening of the concrete collars in pools structured in accordance with the prior art, panel sections have been known to detach from the concrete and effectively fall away.

An additional disadvantage and one of particular importance and expense with respect to the prior art structure is the inability to utilize pre-shaped coping sections with respect to pools which are formed on-site. Thus the formation of a support panel on-site will result in a customized, often irregular radius. Such customized radius is seldom, if ever, a radius to which pool coping sections are constructions. Because pool copings are not easily bendable the resulting work product is often unsatisfactory in its construction, particularly in terms of a matching of the pool-shaped radius to the coping radius.

Yet a further disadvantage of known pool structures of the type to which the invention is directed is the fact that the on-site construction results in pools of inconsistent quality. Thus the ultimate quality of the particular pool is dependent upon the skill of the on-site constructor and bears little relationship to the skill and quality control techniques of the original panel manufacturer. Needless to say this leaves a great deal to chance.

SUMMARY OF THE INVENTION

It is an object of this invention, therefore, to provide a panel system for constructing pools of the type contemplated wherein all paneled segments are fabricated completely within a manufacturing plant and on-site construction operations are limited to assembly.

A further object of the present invention is to provide a pool panel structure which is substantially stronger than comparable structure as presently known in the prior art.

Yet another object of the present invention is to provide a pool panel structure wherein there may be achieved a positive structural bond between structural concrete utilized in the pool construction and the pool panel itself.

Still a further object of the present invention is to provide a pool structure utilizing a minimum number of panels for forming a plurality of pools in free form shapes.

These objects and others not enumerated are achieved by the pool frame structure of the present invention which may include a plurality of panels chosen from a group comprising panels having four different radii, wherein the structural relationship among the radii of the respective panels are specifically defined and wherein the respective panels are secured in a desired relationship and in abutment end to end to define a closed geometric figure corresponding to the desired pool shape.

A pool panel segment formed in accordance with the present invention may include a first generally U-shaped panel which is curved to define a radius, a second generally U-shaped panel curved correspondingly to the first channel and a wall plate having an upper edge and a lower edge, the wall plate being rigidly secured to the first and second U-shaped channels at its upper and lower edges respectively.

BRIEF DESCRIPTION OF THE DRAWINGS

A more complete understanding of the present invention may be had from the following detailed description particularly when read in the light of the accompanying drawings wherein.

DETAILED DESCRIPTION

Figure 1:
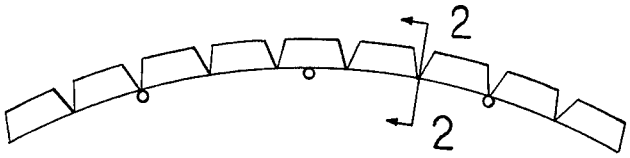
FIG. 1 is a plan view of a panel segment structured in accordance with the prior art.
Figure 2:
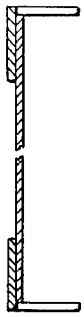
FIG. 2 is a cross-sectional view to the plane 2—2 of the prior art panel segment.
Figure 3:
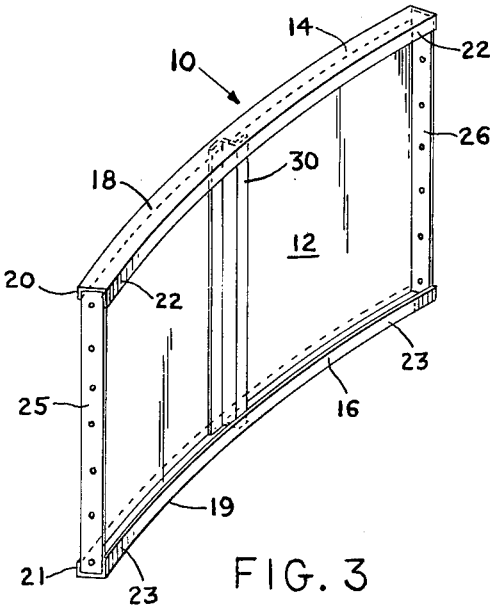
FIG. 3 is a perspective view of a panel segment structured in accordance with the present invention.
Figure 4:
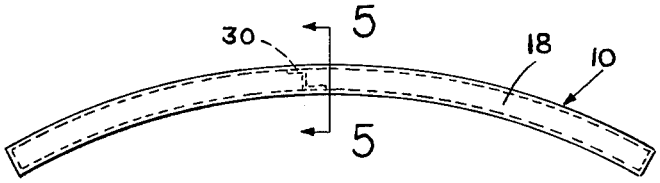
FIG. 4 is a plan view of the panel segment of FIG. 3.

The present invention relates to swimming pools. More specifically the present invention relates to swimming pools of the type wherein a frame structure is utilized to outline a pool shape whereafter a liner is installed to contain the water.

Thus, the present invention is directed to a pool frame structure, comprising a plurality of panels and panel segments, which are prefabricated and which may be utilized to form a plurality of "free form" pool shapes.

Referring therefore to FIGS. 3 through 6, a pool panel segment structured in accordance with the present invention is shown and designated generally by the reference numeral 10.

Panel segment 10 comprises a wall plate 12, an upper channel 14 and a lower channel 16. Upper and lower channels 14, 16 are generally U-shaped each having a base, 18, 19 respectively, a short flange 20, 21 respectively and a long flange 22, 23, respectively.

Figure 5:
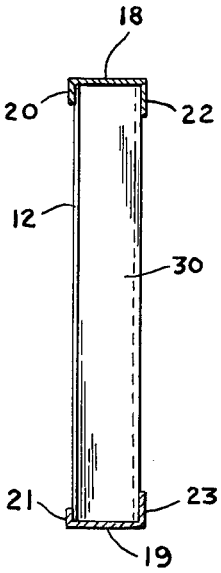
FIG. 5 is a cross-sectional elevational view through the plane 5—5 of FIG. 4.
Figure 6:
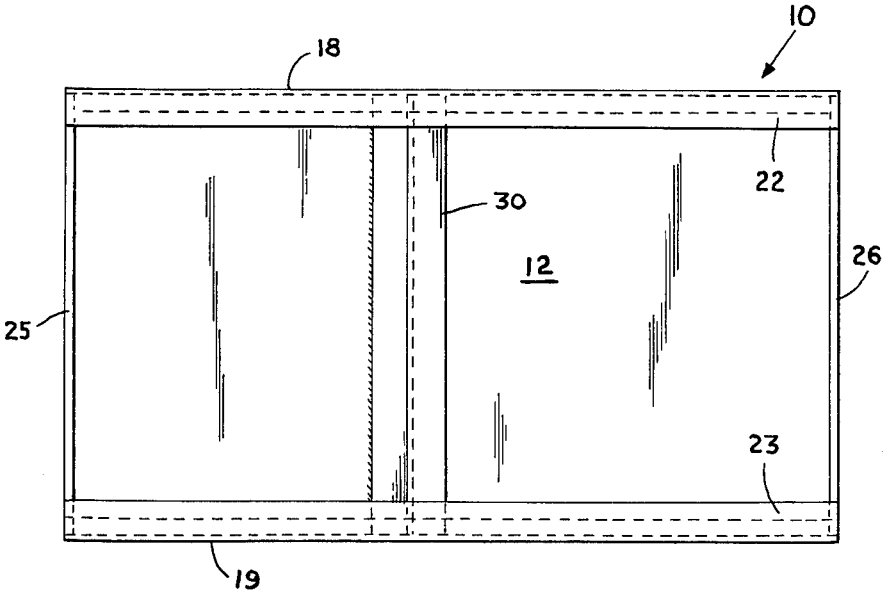
FIG. 6 is an elevational view of the panel of FIG. 3.

As best may be seen in FIG. 5, wall plate 12 is received within U-shaped channels 14 and 16. The upper outer edge of wall plate 12 is secured such as by tack welding to the inside surface of short flange 21.

Formed on the ends of wall plate 12 and first and second end flanges 25, 26, respectively. Flanges 25 and 26, which may be formed by bending a sheet of metal to define a wall 12 having flanges 25, 26, are provided with a plurality of through holes 28 which are adapted to receive bolts (not shown) therethrough. Through holes 28 are positioned to be vertically aligned with similar holes formed in flanges of adjacent panel segments such that the panels may be rigidly secured in vertical alignment during assembly.

The length of flanges 25, 26 is such as to permit the flanges to be received within the channel of U-shaped channels 14 and 16. The flanges 25, 26 are retained in this position by being tack-welded along the joints between their edges and the adjacent surfaces of channels 14 and 16.

Disposed generally parallel to and equidistant between flanges 25 and 26 is a stiffener 30. Stiffener 30 is an elongated member having a Z-shaped cross-section. The ends of stiffener 30 are rigidly secured to channels 14 and 16 such as by tack welding. Similarly, the longitudinally extending edges of stiffener 30 next to wall plate 12 are secured to wall plate 12 such as by tack welding.

The material utilized for panel segments 10 may be any of many corrosion resistant materials known to those having skill in these arts. However, it has been found desirable to fabricate the panel segments from a 14 gauge copper bearing steel having a finish of two ounces per square foot of galvanized coating.

In manufacturing the panel segments, the U-shaped channels 14, 16 are cut to the desired length and bent to the desired radius. A flat sheet of material is drilled to provide the desired bolt holes and then bent to define flanges 25 and 26. Channels 14 and 16 are then positioned as shown in FIG. 5 such that the upper and lower edges of plate 12 are in surface-to-surface contact with short flanges 20, 21 of channels 14, 16, respectively. It has been found that a plurality of wedging blocks placed between the back surface of plate 12 and the long flanges 22, 23 at spaced positions insure a good surface-to-surface contact between plate 12 and short flanges 20, 21. With the channels and plate so positioned, the parts may be tack welded. Thereafter, if desired for stiffening purposes, stiffener 30 may be positioned and tack welded into place.

As stated above, the radius and length of each panel segment is predetermined. It was also stated as an object of the present invention to provide capability for manufacturing a plurality of "free form" shapes using a minimum number of prefabricated panel segments. This object has been achieved in the present invention by establishing a radius related "free form" kidney shaped pool and using panels comprising panel segments which are satisfactory for use in the kidney shaped pool as well as component panels for pools having other shapes. The radius relationships established permit sizing of the pool in an infinite number of sizes.

Figure 7:
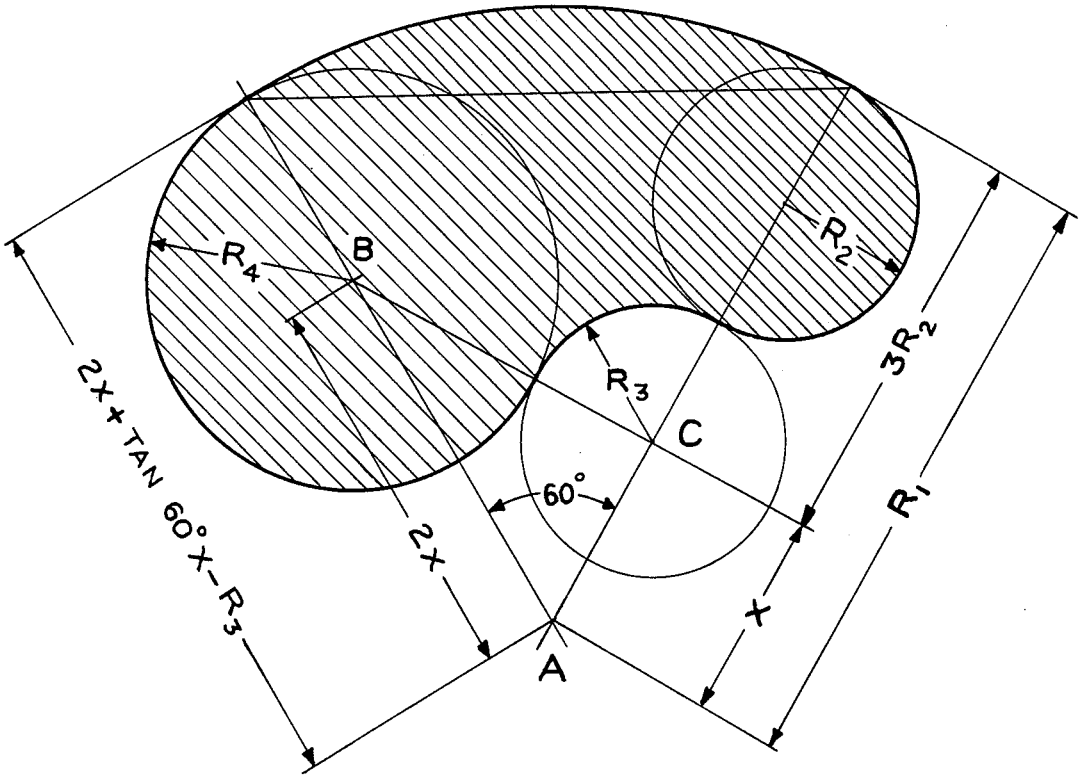
FIG. 7 is a figure denoting the geometric analysis for defining a kidney shaped pool structured in accordance with the invention.

Referring, therefore, to FIG. 7, there is shown in cross-hatching the area defined by a kidney shaped pool having structural geometric relationships in accordance with the present invention. It can be seen that the kidney shape of the pool is defined by arcs having four radii. Thus there is a large radius $R_1$, a small radius $R_2$, a small radius $R_3$ which is equal to $R_2$ but which is separately denominated to underline the fact that panels having radius $R_3$ are outside-bend panels while panels having radius $R_2$ are inside bend panels, and an intermediate radius $R_4$.

As can be seen from FIG. 7, the following relationships are immediately evident:

$$R_1 = 2\,R_2 + R_3 + X;$$
$$R_2 = R_3, \text{ therefore;}$$
$$R_1 = 3R_2 + X.$$

Line BC is also established to be perpendicular to AC. Thus angle B is 30°. This angular relationship establishes the length of line AB as 2X, i.e., twice as long as line AC. Similarly, basic trigonometric relationships establish the length of line BC as tan 60° X. Thus it can be stated that:

$$X + 3R_2 = 2X + \tan 60^\circ X - R_2;$$

or $$4R_2 = X + \tan 60^\circ X;$$
$$4R_2 = X + 1.732X;$$

and $$R_2 = \frac{2.732X}{4}$$

Based upon the foregoing a pool of virtually any size may be constructed by choosing a value for $R_2$, calculating the remaining radii and structing the panels and panel segments accordingly.

By way of example, the following kidney shaped pool has been developed and constructed:

$$R_2 = 7 \text{ feet} - 2 \text{ inches}$$

$R_3$ = 7 feet − 2 inches (reversed bend)

$$X = \frac{4R_2}{2.732} = 10' - 6''$$

Figure 8:
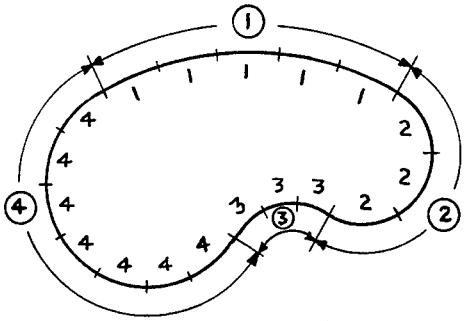
FIG. 8 is a schematic panel layout for a kidney shaped pool structured in accordance with the present invention.

$R_1 = 3R_2 + 10$ feet − 6 inches = 32 inches − 0 inches $R_4 = 1.732X - R_2 - 11$ feet − 0 inches Referring to FIG. 8 there is shown the panel layout for a kidney shaped pool according to the invention. Panels having a radius $R_1$ are shown to comprise panel segments designated 1. Panels having a radius $R_2$ are shown to comprise panel segments designated 2. Panels having a radius $R_3$ are shown to comprise panel segments designated 3. Similarly, panels having a radius $R_4$ are shown to comprise panel segments 4.

In FIG. 8 and based upon the example disclosed above there are five panel segments of radius $R_1$ (32 feet − 0 inches) each of which defines 12° of arc for a total panel arc of 60°. There are three panel segments of radius $R_2$ (7 feet − 2 inches) each of which defines 60° of arc for a total panel arc of 180°. There are three panel segments of radius $R_3$ (7 feet − 2 inches reverse) each of which defines 30° of arc for a total panel arc of 90°. Finally there are seven panel segments of radius $R_4$ (11 feet − 0 inches) each of which defines 30° of arc for a total panel arc of 210°.

Assembly of the pool frame using the disclosed panels may be accomplished using conventional pool construction methods. Thus the frame is assembled in an excavation of proper shape, care being given to maintaining the bed grade level. A bottom collar of concrete is then poured to a depth sufficient to more than fully cover the lower U-shaped channels 16 of each panel segment e.g. a minimum depth of 6 inches. Care should be taken to insure that the concrete fills U-shaped channels 16 in order to establish a firm mechanical bond between the concrete and the frame structure.

After the lower collar is poured and permitted to cure the excavated space around the frame may be backfilled. In this regard, it has been found that the backfill should be installed in layers not exceeding 9 inches in depth. Each layer should be puddled and carefully tamped. Further the pool should be filled while backfilling with the water level being maintained as closely as possible to the level of the backfill.

Filling is terminated at an excavation depth desired for the pool deck. In no event should fill be carried so high as to come in contact with upper U-shaped channel 14. With the backfill at the desired level, an upper collar is poured which may be integral with the pool deck. Again care should be taken to insure that concrete is forced upwardly into the channel of U-shaped channel 14 such as to establish a rigid mechanical bond between the channel and the concrete.

With the structure so completed the deck may be finished and the coping installed. In this regard it should be noted that because pre-shaped panels are utilized and because no "custom" bending is required at the pool site, the pre-shaped coping will fit the panel sections with ease.

As noted above, panel sections developed by the structural relationships established for a kidney shaped pool may be used for constructing free form pools of other shapes.

Figure 9:
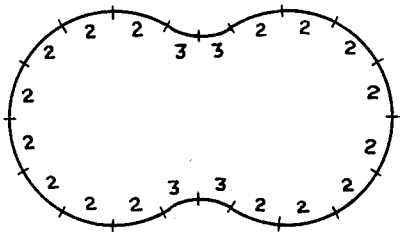
FIG. 9 is a schematic panel layout of a pool shaped as a figure eight and structured in accordance with the present invention.

Referring to FIG. 9 it can be seen that a pool frame in the shape known as a "figure eight" is constructed using sixteen panel segments having a radius $R_4$ and four panel segments having a radius $R_3$.

Figure 10:
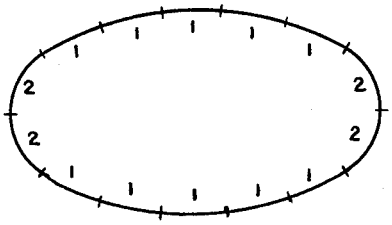
FIG. 10 is a schematic panel layout of an oval shaped pool structured in accordance with the present invention.

Similarly there is shown in FIG. 10 a pool frame in the shape known as "oval" wherein there are used the panel segments of radius $R_1$ and four panel segments of radius $R_2$.

There is little limit to the sizes or shapes of "free form" pools which may be constructed using pre-fabricated panels according to the invention. Further, the four basic panel segments shown, i.e., panel segment 1 having a radius $R_1$ and arc of 12°, panel segment 2 having a radius $R_2$ and an arc of 60°, panel segment 3 having a radius $R_3$ and an arc of 30°, and panel segment 4 having a radius $R_4$ and an arc of 30°, provide the availability of virtually all basic free form shapes with a requirement for a minimum of inventory.

In view of the foregoing it will be recognized by those skilled in these arts that the present invention permits conversion of what heretofore had required custom fabrication into work that can be done by prefabrication with attendant economics and improved quality.

It will also be recognized by those skilled in these arts that the disclosed embodiments and applications are preferred but that many modifications and variations may be made without departing from the spirit and the scope thereof.

What is claimed is:

1. A pool frame structure for forming freeform pools, said pool frame structure including a plurality of panel segments secured in abutting end to end relationship to define a closed geometic figure, wherein each of said panel segments comprises:

a first generally U-shaped channel, said first generally U-shaped channel being curved to define a radius;

a second generally U-shaped channel, said second generally U-shaped channel being curved to define a radius equal to the radius defined by said first U-shaped channel; and a wall plate having an upper edge and a lower edge, said wall plate being rigidly secured to said first and second U-shaped channels at its upper and lower edges respectively and said wall plate further having end flanges extending between said upper edge and said lower edge, said end flanges for being in abutting surface-to-surface contact with the end flanges of next adjacent panel segments upon assembly of said panel segments to form said freeform pool.

2. A panel segment according to claim 1 wherein each of said first and second generally U-shaped channels is an elongated member having a base portion, a short flange extending normally to said base portion and a long flange extending normally to said base portion.

3. A panel segment according to claim 2 wherein said upper and lower edges of said wall plate are in surface-to-surface engagement with said short flanges of said first and second generally U-shaped channels, respectively and displaced from said long flanges of said first and second generally U-shaped channels, respectively.

4. A pool frame structure according to claim 1 wherein said panel segments are chosen from a group comprising a first panel segment having U-shaped channels the radius of each being R-1, a second panel segment having U-shaped channels the radius of each being R-2, a third panel segment having U-shaped channels the radius of each being R-3 and a fourth panel segment having U-shaped channels the radius of each being R-4, and wherein the structural relationships of the degree of curvature among the respective panel segments are defined as follows:

a. the radius R-1 is equal to 3 times the radius R-2 plus a value X;
b. the radius R-2 is a specific value;
c. the radius R-3 is equal to radius R-2 but reversed with respect thereto;
d. the radius R-4 is equal to 1.732 times the value X minus R-2; and
e. the value X is equal to 1.464 R-2.

5. A pool frame structure according to claim 4 wherein at least one of each of said panel types is used to define a "kidney" shaped pool.

6. A pool frame structure according to claim 5 wherein said pool includes: at least one of said first type panels to define a frame arc of 60°, at least one of said second type panels to define a frame arc of 180°, at least one of said third panels to define a frame arc of 90° and at least one of said fourth panels to define a frame arc of 210°.

7. A pool frame structure according to claim 6 wherein each of said at least one panels includes a plurality of panel segments.

8. A pool frame structure according to claim 7 wherein said first panel includes five segments, said second panel includes three segments, said third panel includes three segments and said fourth panel includes seven segments.

9. A pool frame structure according to claim 4 wherein at least two of said first panels and at least two of said second panels are used to define an oval shaped pool.

10. A pool frame structure according to claim 9 wherein each of said first panels defines an arc of 60° and wherein each of said second panels defines an arc of 120°.

11. A pool frame structure according to claim 10 wherein each of said first and second panels comprises a plurality of panel segments.

12. A pool frame structure according to claim 11 wherein each of said first panels includes five panel segments and wherein each of said second panels includes two panel segments.

13. A pool frame structure according to claim 4 wherein at least two of said third panels and at least two of said fourth panels are used to define a "figure eight" shaped pool.

14. A pool frame structure according to claim 13 wherein each of said third panels defines an arc of 60° and each of said fourth type panels defines an arc of 240°.

15. A pool frame structure according to claim 14 wherein each of said third and fourth panels comprises a plurality of panel segments.

16. A pool frame structure according to claim 15 wherein each of said third panels includes two panel segments and wherein each of said fourth panels includes eight panel segments.

17. A panel segment for constructing a pool frame comprising:

a first generally U-shaped channel, said first generally U-shaped channel being curved to define a radius;
a second generally U-shaped channel, said second generally U-shaped channel being curved to define a radius equal to the radius defined by said first U-shaped channel; and
a wall plate having an upper edge and a lower edge, said wall plate being rigidly secured to said first and second U-shaped channels at its upper and lower edges respectively and said wall plate further having end flanges extending between said upper edge and said lower edge, said end flanges adapted to be received in surface-to-surface contact with end flanges of next adjacent panel segments upon assembly of said panel segments to form a freeform pool.

18. A panel segment according to claim 17 wherein each of said first and second generally U-shaped channels is an elongate member having a base portion, a short flange extending normally to said base portion and a long flange extending normally to said base portion.

19. A panel segment according to claim 18 wherein the upper and lower edges of said wall plate are in surface-to-surface engagement with said short flanges of said first and second generally U-shaped channels, respectively.

* * * * *